United States Patent [19]

Johansson

[11] Patent Number: 4,787,221

[45] Date of Patent: Nov. 29, 1988

[54] APPARATUS FOR PELT PROCESSING

[76] Inventor: Ingvar Johansson, Hans Arons väg 3, 311 04 Falkenberg, Sweden

[21] Appl. No.: 48,423

[22] Filed: May 11, 1987

[30] Foreign Application Priority Data

May 16, 1986 [SE] Sweden ..... 8602228

[51] Int. Cl.[4] ..... C14B 1/10; C14B 7/08

[52] U.S. Cl. ..... 69/40; 69/44; 69/45

[58] Field of Search ..... 69/19.2, 19.3, 40, 44, 69/45, 46, 47

[56] References Cited

U.S. PATENT DOCUMENTS 1,320,223 10/1919 Guy ..... 69/19.2
2,910,856 11/1959 Fredrickson ..... 69/46
2,941,391 6/1960 Henfung ..... 69/46
4,314,465 2/1982 Reid ..... 69/40

FOREIGN PATENT DOCUMENTS 74546 3/1983 European Pat. Off. ..... 69/19.2

*Primary Examiner*—Wm. Carter Reynolds
*Attorney, Agent, or Firm*—Beveridge, DeGrandi & Weilacher

[57] ABSTRACT

An apparatus for fleshing fur pelts with two conical poles, on each of which the pelt is positioned with the fur side facing inwardly. A ring is disposed concentrically of one pole. The ring is clamped to the pelt and moved axially of the pole by a piston driven carriage, which mounts the ring, to tension the pelt. The pole is rotated to allow a rotary scraper to flesh the pelt.

11 Claims, 7 Drawing Sheets

APPARATUS FOR PELT PROCESSING

BACKGROUND OF THE INVENTION

The present invention relates to an apparatus for scraping animal pelts, for example mink pelts, fox pelts etc., comprising one or more poles on which the pelt is positioned with its fur surface facing inwardly. Each pole is rotated or turned successively during scraping of the pelt thereon by means of a scraper blade or a fixed or rotary scraper jaw.

Different machines have long been known in this art for facilitating the onerous and stressful pelt processing work carried on at pelt-producing farms of various types. One such machine is a fleshing machine in which the pelt is scraped by means of a fixed or rotary scraper blade or scraper jaw while the pelt is positioned and tensioned on a rotary, conical pole of wood or glass fibre. These prior art machines require considerable manual effort, for which reason it is extremely difficult to further increase their capacity and output efficiency. Certain attempts have been made to automate part of the manual phases in such operations, but the difficulties thus involved have hitherto proved to defy ready solution.

SUMMARY OF THE INVENTION

The object of the present invention is to provide an efficient fleshing—or pelt processing—machine and, above all, to automate work at such machines to the extent possible.

This object is attained according to the present invention, in that a pelt tensioning member is disposed in or on the pole and is provided with a number of pelt clamps for fixedly retaining the pelt; the pelt tensioning member consists of a ring which is movable along the pole; and means are provided for engaging with the ring and displacing the ring along the pole for stretching the pelt retained by means of the clamp or clamps while the pelt is scraped by the scraper blade or scraper jaw. The pelt clamp or pelt clamps are radially displaceable on the ring. One or more springs are provided to urge the pelt clamp or pelt clamps against the pole. The means for actuating the ring consist of a collar, whose shanks extend down on both sides of the pole for engagement with the ring at least two positions during displacement of the ring along the pole. The collar is provided with a plurality of wheels, rollers, balls or the like for reducing the friction between the collar and the ring. The collar is connected to drive means for reciprocating the collar along the pole. This drive means comprise a piston and cylinder assembly. The pole is rotated by means of a motor-driven friction plate which is axially movable into and out of engagement with the end of the pole. The head with the rotary scraper jaw is mounted on a carriage which is movable along the pole by suitable drive means in the form of, for example, a piston and cylinder assembly. The carriage is positioned substantially vertically and is provided with two heads for simultaneous fleshing of a pelt on the pole.

An apparatus according to the present invention makes it possible to carry out major parts, if not all, of the fleshing work fully automatically, whereby the only manual labor required is for positioning and fixedly clamping the pelt. Obviously, this entails a considerably higher degree of efficiency. In the apparatus according to the present invention, the pelt is clamped in an extremely reliable and effective manner, and moreover, the apparatus according to the present invention provides for extremely reliable and effective positive tensioning of the pelt, whereby the application and switching of the fleshing jaw head may be executed using suitable piston and cylinder assemblies, which thereby renders this operation fully automatic. As a result of the reliable and efficient tensioning of the pelt in the apparatus according to the present invention, the risk of damage to the pelt has been considerably reduced. At the same time, the risk of forced penetration of animal fats and grease to the fur side of the pelt is reduced, in that the pressure of the scraper jaw need not be unduly excessive. It has proved to be possible to reduce such pressure from 6 bars to 2 bars.

In the apparatus according to the present invention, it is, moreover, possible to vary and modify to a considerable extent the different operative parameters, such as tensioning force, speed of rotation of the pole, abutment pressure of the scraper jaw, speed of displacement of the scraper jaw etc.

As a result of the apparatus according to the present invention, it is possible to carry out the fleshing of one pelt during a single revolution of the pole, which is a considerable improvement in relation to prior art apparatuses in which, as a rule, several revolutions of the pole are necessary. Moreover, the fleshing operation will be rendered more efficient, since it has become possible to reduce the consumption of treatment sawdust during the tumbling operation, and also the tumbling time proper.

BRIEF DESCRIPTION OF THE DRAWINGS

The nature of the present invention and its aspects will be more readily understood from the following brief description of the accompanying drawings, and discussion relating thereto.

In the accompanying drawings.

DETAILED DESCRIPTION OF THE PREFERRED EMBODIMENTS

The embodiments of the present invention shown on the drawings are substantially intended for fleshing, or processing, mink pelts, but may, naturally also be employed for fleshing other, similar pelts, while the principle forming the basis of the present invention is also applicable to similar apparatuses for fleshing other types of pelts.

Figure 1:
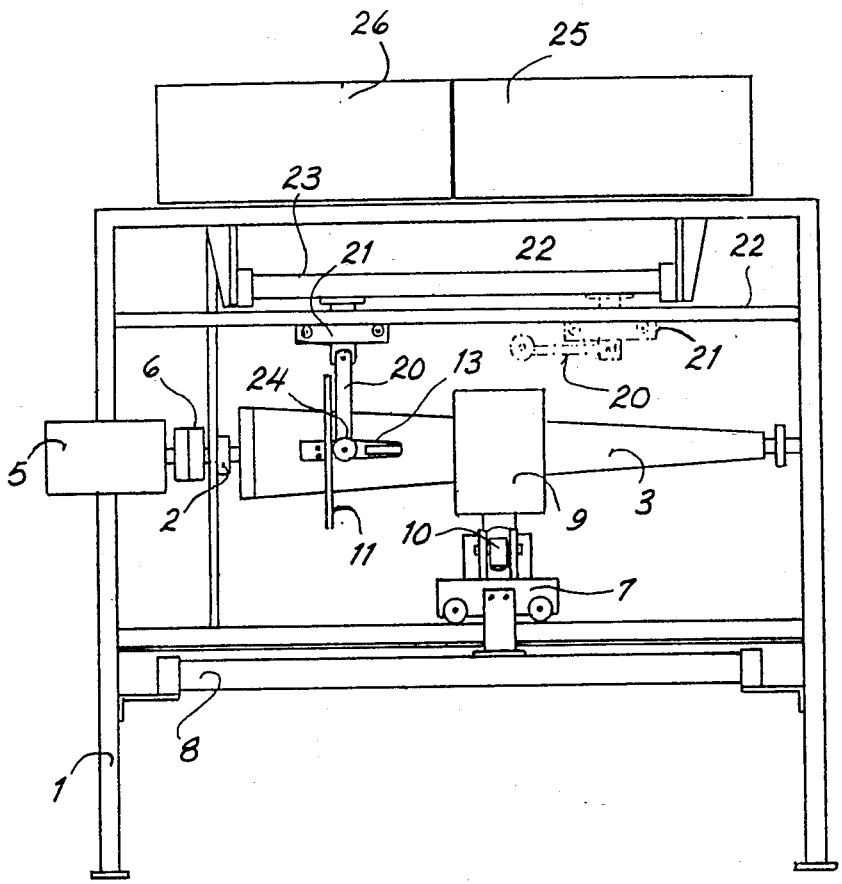
FIG. 1 is a schematic view of one embodiment of an apparatus according to the present invention.
Figure 2:
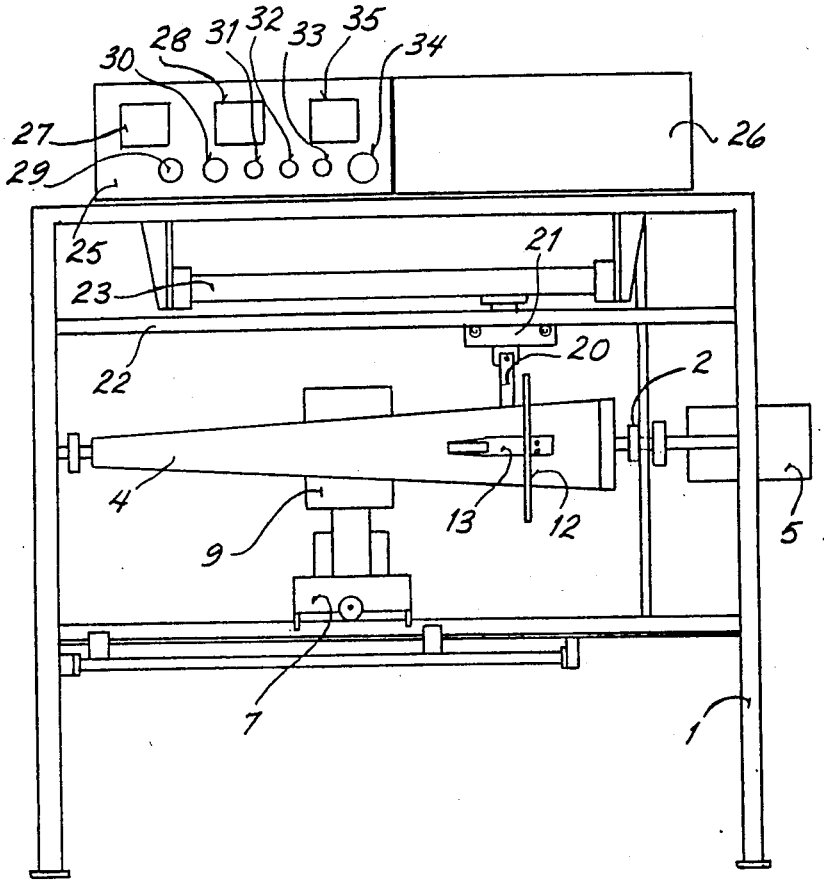
FIG. 2 is a view similar to that of FIG. 1, but seen from the opposite side.
Figure 3:
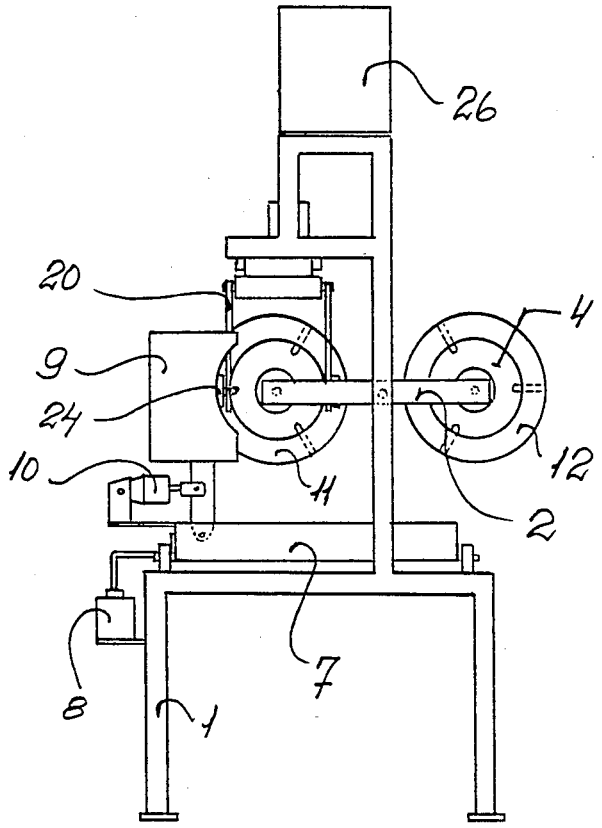
FIG. 3 is an end view of the embodiment in FIGS. 1 and 2.

Referring to the drawings, the embodiment shown in FIGS. 1, 2 and 3 includes a floor frame 1, in which there is disposed a pivotal or rotary cradle 2 with two parallel, conical poles 3 and 4. The poles 3 and 4 are turnable or rotatable in the cradle 2 which, in its turn, is pivotally or rotatably disposed on the frame 1. The pole 3 in FIG. 1 is successively and stepwise rotatable by means of a motor 5 by the intermediary of a drive plate 6 which is switchable into and out of driving engagement with the end of the pole 4. Beneath the cradle 2, and thereby also the poles 3 and 4, there is disposed a carriage 7 which is reciprocally displaceable along the poles 3 and 4, by means of a piston and cylinder assembly 8. A head 9 with a per se conventionally rotating scraper jaw is disposed on the carriage 7. The head 9 is also of conventional type and is pivotal towards and away from the pole 4. In the present apparatus, a piston and cylinder assembly 10 is provided for switching the head 9 towards and away from the pole 4.

Rings 11 and 12 are disposed on the poles 3 and 4. The rings 11, 12 are displaceable along the poles 3 and 4, and each ring 11, 12 is, in the present embodiment, provided with three clamps 13 which are radially displaceable in a space between the poles 3 and 4, and the inside of the rings 11 and 12. The rings 11 and 12 and the clamps 13 are identical and one embodiment thereof is shown in greater detail in FIGS. 7, 8, 9 and 10. Each clamp 13 is provided with two parallel pins 14 and 15 which each extend through a respective sleeve 16 and 17, which are sleeves in turn are anchored on the rings 11 and 12. Springs 18 and 19 are disposed on the pins 14, 15 between the sleeves 16 and 17, for urging the clamps 13 against the poles 3 and 4. Thus, the clamps 13 are constantly urged against the surface of the poles 3 and 4.

A yoke-like collar 20 is disposed above the cradle 2 and, thereby, the poles 3 and 4, for moving the ring 12 with its clamps 13 and for thereby tensioning the pelt in the clamps on the pole 4, while the pole 3 is accessible and a pelt may be applied thereon by being held by in the clamps 13 on the ring 11. In FIG. 1, the collar 20 is illustrated in the lowered position over the pole 4 during displacement of the ring 11 in a direction tensioning the pelt and with dotted lines the collar 20 is shown in a raised position to permit switching of the poles 3, 4, or pivoting of the cradle 2 for pelt replacement.

The collar 20 is pivoted by means of a piston and cylinder assembly or by means of a cam mechanism which pivots the collar to the position shown with dotted lines, when it is located in its end position. The collar 20 may be spring-biased towards the lowered position shown with solid lines. Furthermore, the collar 20 is mounted on a carriage 21 which runs on a rail 22 above the cradle 2 with the poles 3 and 4. The carriage 21 is movable along the rail 22 and, thereby, the poles 3 and 4, by means of a piston and cylinder assembly 23. As soon as the piston and cylinder assembly 23 has moved the carriage 21 away from the position illustrated with dotted lines, the collar 20 is pivoted to a position with its shanks substantial vertical so that these may enter into engagement with the ring on the pole and shift the ring on the pole 4 during tensioning of the pelt thereon, the pelt being fixedly retained in the clamps 13. The shank ends of the collar 20 may suitably be provided with wheels 24 for reducing the friction against the ring 12 rotating with the pole 4.

The rings 11 and 12, with the clamps 13 and the collar 20 for switching the rings 11 and 12, permit a high degree of automation of fleshing of the pelt. The piston and cylinder assemblies included in the apparatus according to the present invention are preferably of the pneumatic type, these forming part of a sophisticated feed system which is disposed in a pair of cabinets 25 and 26 located above the rail 23. Metering devices 27 and 28, dial switches 29, 30 and push buttons 31, 32, 33 and 34 are disposed on the cabinet 25. A counter 35 is, further, included. Suitably, the force with which piston and cylinder assembly 23 is to displace the collar 20, and thereby the ring 12, is adjusted by means of the dial switch 29. This thus determines the force with which the pelt is tensioned. This force may be read from the instrument 27. The dial switch 30 is employed to set the force with which the scraper jaw or scraper head 9 is to be urged against the pelt, and thereby the pole 4. This force may be read from on the instrument 28. The push buttons 31, 32 and 33 are employed to initiate various operative phases or operative sub-phases. The push button 34 is an emergency stop. It is also possible, using the push buttons 31–33, to select different movement sequences. This optional mode is possible due to the construction of the apparatus according to the present invention.

For example, the push button 31 is intended for fully automatic fleshing of a complete pelt, in which the piston and cylinder assembly 23 is placed under operative pressure and urges the collar 20 against the ring 12 for tensioning the pelt, whereupon the rotary scraper jaw in the head 9 is applied against the pelt by means of the piston and cylinder assembly 10 and the carriage 7 is displaced by means of the piston and cylinder assembly 8 along the pole 4 to the end of the pelt in the clamps 13. The collar 20, or the ring 12, may trigger against a limit position on the carriage 7 or the head 9 for reciprocating the carriage to its starting position, whereupon the drive plate 6 is caused to turn or rotate the pole 4 through one step, the extent of which is adjustable. The counter 35 permits adjustment of the desired number of steps on one turn or revolution and progressively indicates the number of executed steps. Normally, the steps are twenty to one revolution, while the available interval may range from between 17 to 32. The number of steps is equal to the number of flesh scrapings.

Using the push button 32, it is possible, for example, to select manual fleshing length, while other phases are effected in dependence thereon. Finally, the push button 33 may be made operative to select manual regulation of the fleshing pressure and fleshing length, and possibly also rotation of the pole.

Figure 8:
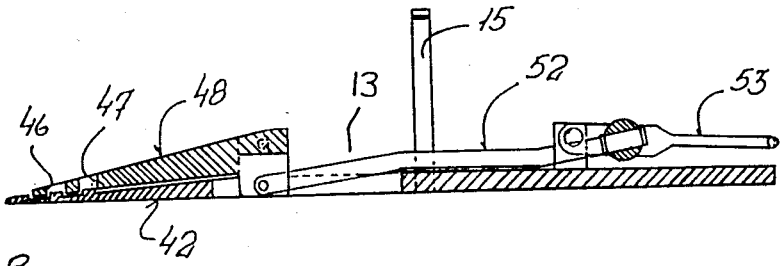
FIG. 8 is a section taken along the line VIII—VIII in FIG. 7.
Figure 7:
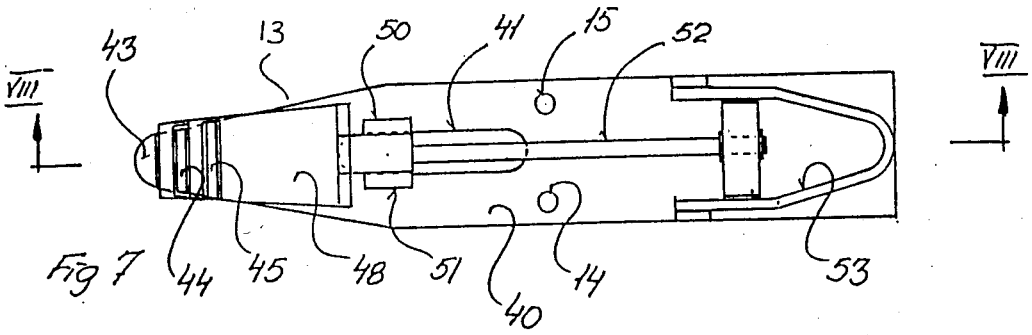
FIG. 7 is a top plan view of a clamp according to one embodiment of an apparatus according to the present invention.
Figure 9:
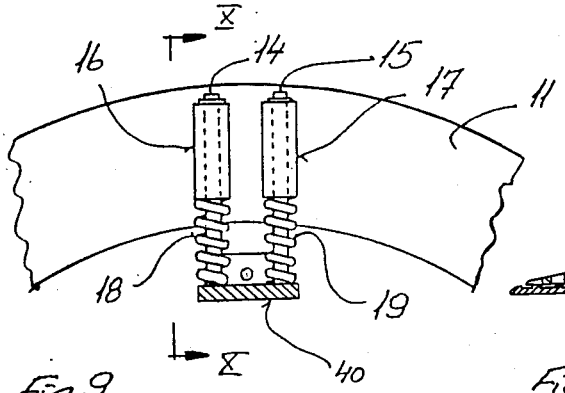
FIG. 9 is a view of a fragment of a ring according to one embodiment of an apparatus according to the present invention and FIG. 10 is section taken along line X—X in FIG. 9.
Figure 10:
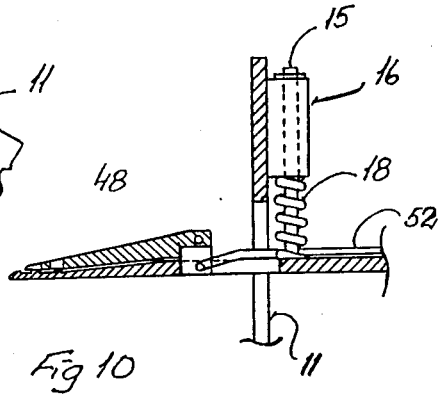

FIGS. 7 and 8 illustrate a particularly preferred clamp 13 which provides an extremely powerful and reliable grasp of the pelt and permits fleshing a considerable distance up onto the clamping beaks without damage to the pelt. This clamp is provided with a bottom 40 with a slightly arched underside and a centrally elongate slot 41 and a gently tapering lower beak 42. The lower beak 42 is provided, on its upper side, with a number of transverse serrations 43, 44 and 45, of which the serrations 44 and 45 mesh in recesses 46 and 47 in an upper beak 48. The upper beak 48 is pivotally journalled on a shaft 49 which extends between lugs 50 and 51 on the bottom 40 on either side of the slot 1. The rear section of the upper beak 48 extends into the slot 41 and is pivotally interconnected with a rod 52 whose end is anchored in an eccentric lock 53 on the end of the bottom 40. Furthermore, the pins 14 and 15 are anchored to the bottom 40 for cooperation with the sleeves 16 and 17, on the rings 11 and 12.

Figure 4:
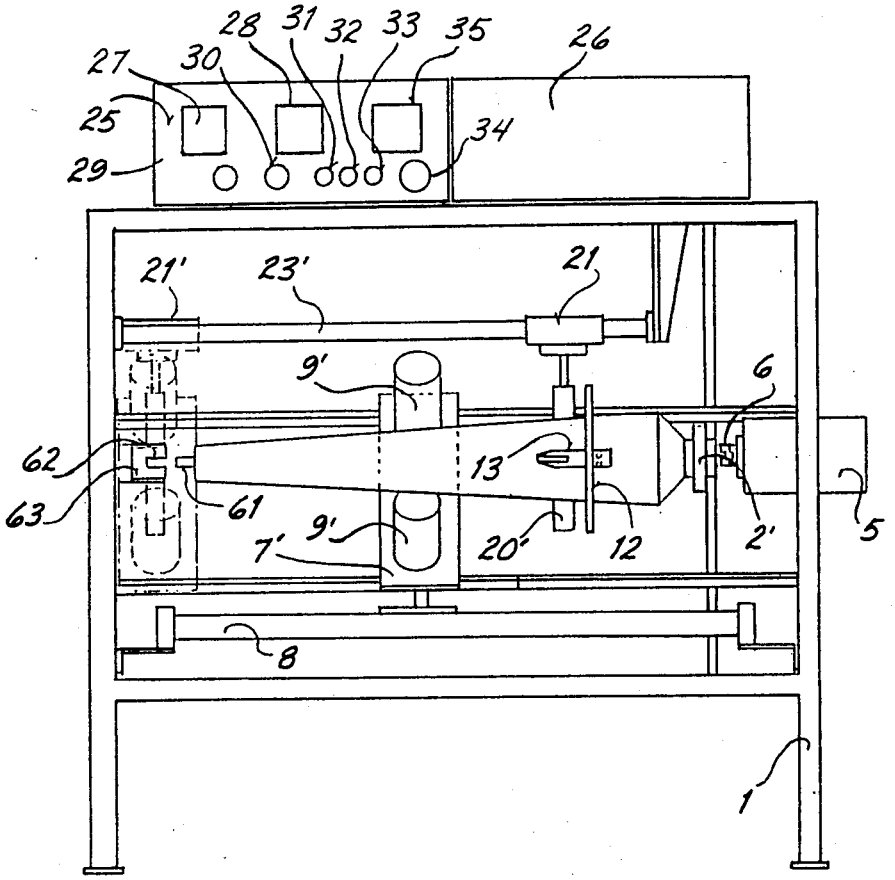
FIG. 4 is a schematic view of an other embodiment of an apparatus according to the present invention.
Figure 5:
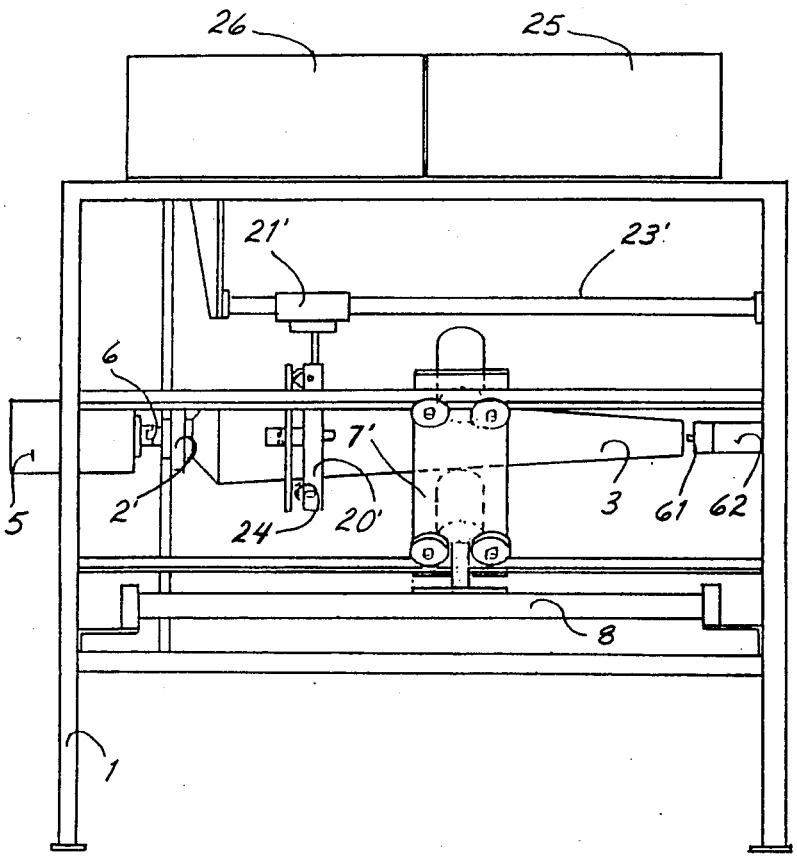
FIG. 5 is a view similar to that of FIG. 4, but seen from the opposite side.
Figure 6:
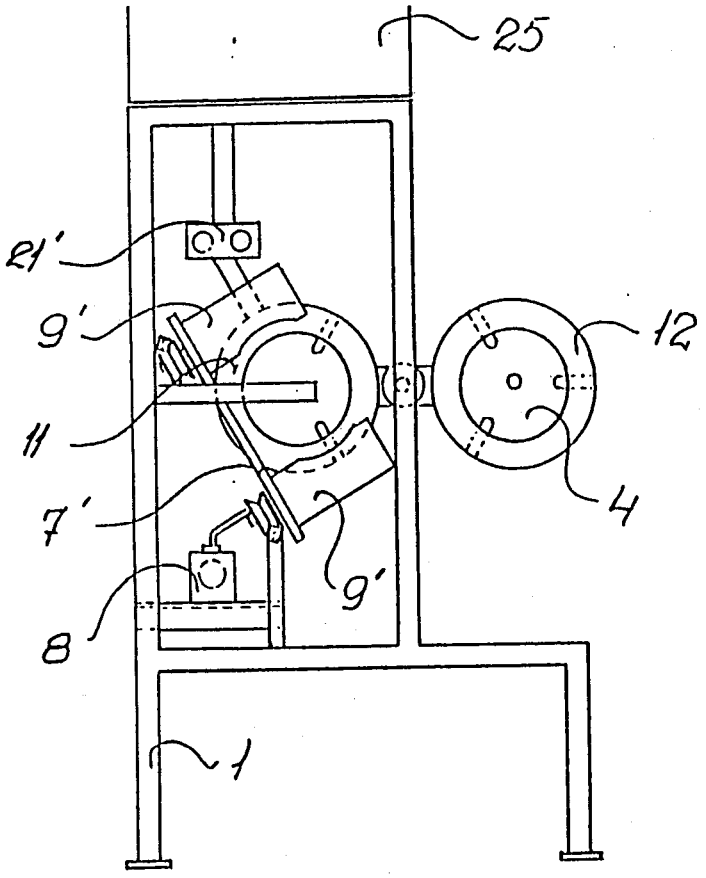
FIG. 6 is an end view of the embodiment in FIGS. 4 and 5.

The embodiment shown in FIGS. 4, 5 and 6 differs from the embodiment in FIGS. 1, 2 and 3 in that the yoke-like collar 20' is a ring which does not need to be swingable but only shiftable along the pole, and in that the carriage 7' has a vertical or almost vertical position and is provided with two heads 9', which are shiftable to and from the pole with one or two piston and cylinder assemblies. In this embodiment the cradle 2' is in the form of a bar 60 rotatable in the frame 1 and carrying one pole at each end of the poles 3 and 4. The opposite end of the poles is provided with a pin 61 for cooperation with a recess 62 in a piston 63 which is shiftable to and from engagement with the pin. With the carriage 7' in the position shown in FIG. 4 with dotted lines the pole 3 is free to be rotated with the bar 60. As shown the ring 20' does not have swing in order to allow shifting of a pole from the working position to the loading position. The ring 20' may be provided with four wheels 24 distributed along the ring.

In a modification, the head and heads 9' may be provided with both a rotating scraper jaw and a fixed scraper blade. Also the head or heads 9' may be provided with suction means for removal of scraped flesh.

The present invention should not be considered as restricted to that described above and shown on the drawings, many modifications being conceivable without departing from the spirit and scope of the appended claims.

I claim:

1. An apparatus for fleshing pelts comprising:

a pole;

means for rotating the pole;

a tensioning ring disposed in concentric relation with the pole;

pelt clamp means carried by the ring for clamping a pelt to the ring;

means for displacing along the pole to tension a pelt on the pole, the displacing means including a rail, a carriage reciprocally movable on the rail, means on the carriage for engaging the ring, and carriage driving means for reciprocally driving the carriage to move the engaging means reciprocally in opposite directions; and scraper means proximate the pole for scraping flesh from a flesh side of a pelt.

2. The apparatus as claimed in 1, wherein the pelt clamp means further comprises means permitting radial movement of the pelt clamp means with respect to the ring.

3. The apparatus as claimed in claim 2, wherein the means for permitting radial movement comprises springs for urging the pelt clamp means against the pole.

4. The apparatus as claimed in claim 1, wherein the means for engaging the ring consists of a collar having shanks extending downwardly on sides of the pole for engaging the ring act at least two points during displacement thereof along the pole.

5. The apparatus as claimed in claim 4, wherein the collar is provided with roller means for reducing friction between the collar and the ring.

6. The apparatus as claimed in claim 4, wherein the carriage driving means consists of a piston and cylinder assembly.

7. The apparatus as claimed in claim 1, wherein the means for rotating the pole further comprises a motor-driven friction plate which is axially switchable into and out of engagement with the end of the pole.

8. The apparatus as claimed in claim 1, wherein the scraper means includes a head with a rotary scraper jaw, a scraper carriage which is displaceable along the pole on a supporting member, and scraper carriage drive means in the form of a piston and cylinder assembly for moving the scraper carriage and the head mounted thereon over the support member and along the pole.

9. The apparatus as claimed in claim 8, wherein the scraper carriage is positioned substantially vertically and the scraper means is provided with two heads for simultaneous fleshing of a pelt on the pole.

10. The apparatus as claimed in claim 1, wherein the carriage driving means comprises pneumatic means.

11. The apparatus as claimed in claim 10, further comprising control means including means for setting tensioning and scraping forces, means for initiating tensioning and scraping operations, and means for indicating applied tensioning and scraping forces.

* * * * *